United States Patent [19]

Abdi

[11] Patent Number: 4,906,915

[45] Date of Patent: Mar. 6, 1990

[54] VOLTAGE TO ABSOLUTE VALUE CURRENT CONVERTER

[75] Inventor: Behrooz Abdi, Chandler, Ariz.

[73] Assignee: Motorola, Inc., Schaumburg, Ill.

[21] Appl. No.: 375,103

[22] Filed: Jul. 3, 1989

[51] Int. Cl.[4] ..... G05F 3/16

[52] U.S. Cl. ..... 323/316; 323/312; 307/296.1; 307/299.2

[58] Field of Search ..... 323/311, 312, 315, 316; 307/296.1, 296.6, 296.7, 299.2, 261, 262, 490, 498

[56] References Cited

U.S. PATENT DOCUMENTS

| | | | |
|---|---|---|---|
| 4,560,920 | 12/1985 | Okanobu | 323/316 X |
| 4,647,839 | 3/1987 | Siligoni et al. | 323/312 |
| 4,682,098 | 7/1987 | Seevinck et al. | 323/316 X |
| 4,717,869 | 1/1988 | Koch et al. | 323/316 |

*Primary Examiner*—Patrick R. Salce
*Assistant Examiner*—Emanuel T. Voeltz
*Attorney, Agent, or Firm*—Michael D. Bingham

[57] ABSTRACT

A voltage to absolute value current converter circuit provides an output current signal which is proportional to the absolute value of the AC portion of an input voltage signal. This conversion is accomplished without the use of a capacitor which allows the circuit to be implemented in integrated circuit form.

7 Claims, 1 Drawing Sheet

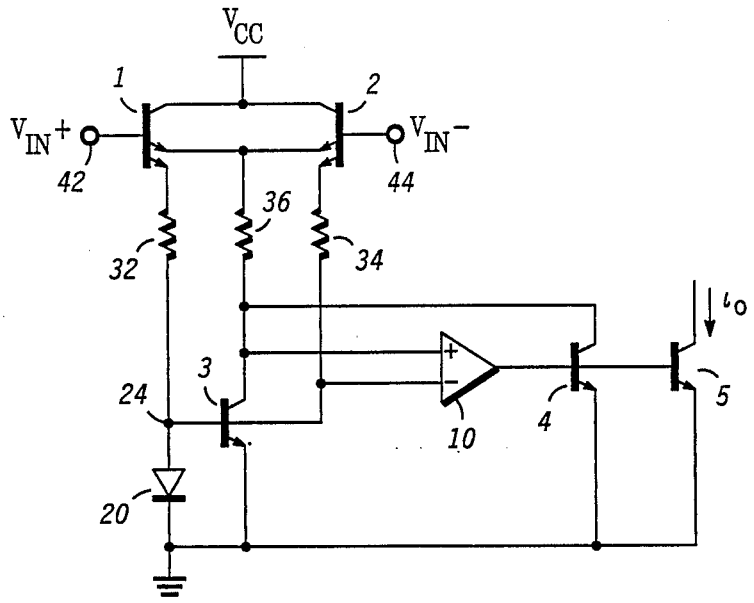
FIG. 1
FIG. 2
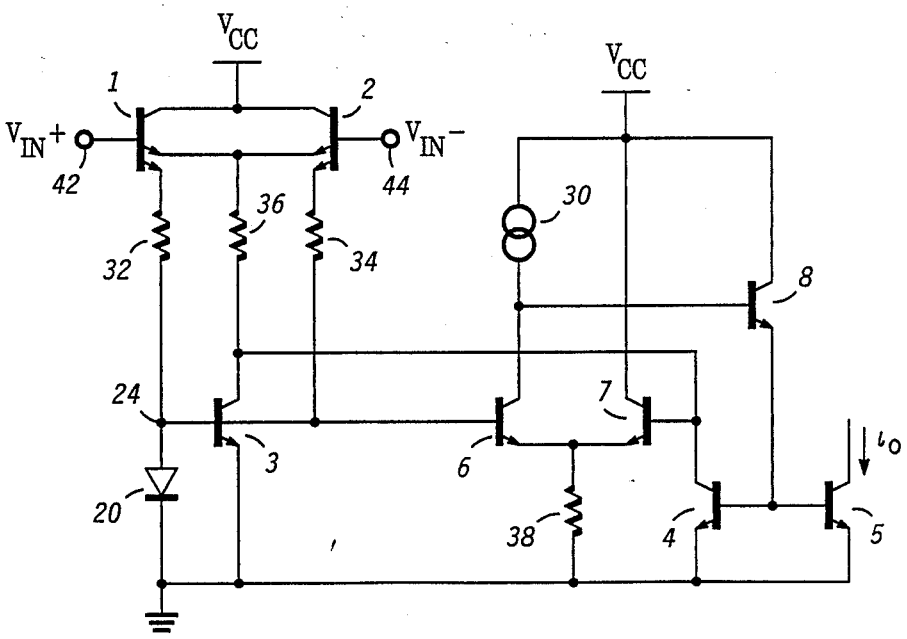

VOLTAGE TO ABSOLUTE VALUE CURRENT CONVERTER

BACKGROUND OF THE INVENTION

This invention relates, in general, to converter circuits and, more particularly, to a circuit which converts an input voltage signal to an absolute value current output signal without the use of a capacitor which allows the converter circuit to be implemented as an integrated circuit.

There are currently available converter circuits which convert an input voltage signal to an absolute value current signal. However, these circuits ordinarily utilize a coupling capacitor to eliminate the DC portion of the signal and are therefore not easily implemented as an integrated circuit.

SUMMARY OF THE INVENTION

It is therefore an object of the present invention to provide a converter circuit which converts an input voltage signal having both DC and AC components to an absolute value current signal having only an AC component.

Another object of the present invention is to provide a converter circuit which accomplishes a voltage to absolute value current conversion without the use of a capacitor.

It is still further an object of the present invention to provide a voltage to absolute value current converter circuit which may be implemented as an integrated circuit.

The above and other features and objects are provided in the present invention wherein there is provided a voltage to absolute value current converter circuit comprising first and second transistors each having a collector, base, and first and second emitter terminals. The collector terminals of the first and second transistors are coupled to each other for coupling to a source of supply voltage and the base terminals of the first and second transistors are for receiving a differential input voltage signal. The first emitter terminals of the first and second transistors are coupled to the first terminal of a first resistor and the second emitter terminals of the first and second transistors are respectively coupled to the first terminals of second and third resistors.

The second terminal of the first resistor is coupled to the collectors of third and fourth transistors and to the noninverting input of an amplifier. The second terminals of the second and third resistors are coupled to the base of the third transistor, to the anode of a diode, and to the inverting input of the amplifier, the output of which is coupled to the base of the fourth transistor and to the base of a fifth transistor. The emitters of the third, fourth and fifth transistors are coupled to the cathode of the diode for coupling to a reference terminal. The collector current of the fifth transistor is proportional to the absolute value of the AC portion of the differential input voltage signal.

BRIEF DESCRIPTION OF THE DRAWINGS

The above mentioned and other features of the invention and the manner of attaining them will become more apparent and the invention itself it will be best understood by reference to the following description of an embodiment of the invention taken in conjunction with the accompanying drawings, wherein:

FIG. 1 is a schematic diagram of a preferred embodiment of the present invention; and FIG. 2 is a more detailed schematic diagram of a preferred embodiment of the present invention showing a detailed implementation of the amplifier portion thereof.

DETAILED DESCRIPTION OF THE DRAWINGS

FIG. 1 is a schematic of the present invention which comprises double emitter NPN transistors 1 and 2, the collectors of which are coupled together for coupling to a source of supply voltage. Base terminals 42 and 44 of transistors 1 and 2 are for receiving an input voltage signal. The first emitters of transistors 1 and 2 are coupled together for coupling to the first terminal of resistor 36. The second emitter of transistor 1 is coupled to the first terminal of resistor 32, the second terminal of which is coupled to the base of NPN transistor 3 and to the anode of diode 20. The second emitter of transistor 2 is coupled to the first terminal of resistor 34, the second terminal which is coupled to the base of transistor 3 and to the negative input terminal of amplifier 10. The second terminal of resistor 36 is coupled to the collectors of transistors 3 and 4 as well as to the positive input terminal of amplifier 10. The output terminal of amplifier 10 is coupled to the bases of NPN transistors 4 and 5, the emitters of which are coupled to the emitter of transistor 3 and to the cathode terminal of diode 20 for coupling to a reference terminal.

The differential input signal applied to terminals 42 and 44 can be broken into two components with respect to ground; namely $(V_{dc}+v_{ac})$ applied to terminal 42 and $(V_{dc}-v_{ac})$ applied to terminal 44, which result in currents flowing through resistors 32 and 34 in series with transistor 1 and 2 emitters; namely $(I_{dc}+i_{ac})$ through resistor 32 and $(I_{dc}-i_{ac})$ through resistor 34. The current through diode 20 ($I_{20}$) is the sum of these currents or:

$$I_{20}=I_{dc}+i_{ac}+I_{dc}-i_{ac}=2I_{dc}$$

This DC current is mirrored by transistor 3 who's collector is held to the voltage at node 24 by amplifier 10. With the value of resistors 32 and 34 being equal and equal to twice the value of resistor 36 the total current through resistor 36 is $2(I_{dc}+i_{ac})$. Note that this current always changes in the same direction regardless of the polarity of the input signal $V_{in}$. The collector current through transistor 4 will then be the total current through resistor 36 minus the current through the collector of transistor 3. The collector current of transistor 4 ($I_4$) will then be:

$$I_4=2(I_{dc}+i_{ac})-I_{20}=2I_{dc}+2i_{ac}-2I_{dc}=2i_{ac}$$

This collector current through transistor 4 is mirrored by the collector current through transistor 5 and consists only of an AC current which is proportional to the AC portion of the input signal voltage between terminals 42 and 44.

As can be seen the AC portion of the currents flowing through resistors 32 and 34, when summed through diode 20, cancel each other out leaving only the DC portion of the current resulting from the input voltage signal applied to terminals 42 and 44. The value of resistor 36 is selected at one half the value of resistors 32 and 34 which are equal in value in order that the DC portion of the current flowing through resistor 36 is equal to the DC portion of the sum of the currents flowing through resistors 32 and 34. This DC portion of the current is shunted through transistor 3 leaving only the AC portion of the total current flowing through resistor 36 to flow through the collector of transistor 4. This AC current is then mirrored by transistor 5 producing an output current signal ($i_0$) which has no DC component and is proportional to the absolute value of the AC portion of the original input voltage signal between terminals 42 and 44. As is evident this conversion is accomplished without the use of a capacitor which allows the illustrated circuit to be implemented in integrated circuit form.

FIG. 2 is a schematic of the present invention which illustrates a more detailed schematic of a typical amplifier 10 circuit. The components other than amplifier 10 of FIG. 1 are connected as before and the amplifier comprises transistors 6,7 and 8 active load 30 and resistor 38. The collector of NPN transistor 8 is coupled to the collector NPN transistor 7 and to the first terminal of active load 30 for coupling to a source of supply voltage. The second terminal of active load 30 is coupled to the base of transistor 8 and to the collector of NPN transistor 6, the base of which is coupled to the second terminal of resistor 34. The base of transistor 7 is coupled to the collector of transistor 4 and the emitters of transistors 6 and 7 are coupled to the first terminal of resistor 38 the second terminal of which is coupled to the emitter of transistor 4 for coupling to a reference terminal. The emitter of transistor 8 is coupled to the bases of transistors 4 and 5.

As can been seen the second terminal of resistor 34 is coupled to the base of transistor 6 which acts as the inverting input of the amplifier. The noninverting input to the amplifier is now the base of transistor 7 which is coupled to the collector of transistor 3. The output of the amplifier is now the emitter of transistor 8 which is coupled to the base terminals of transistors 4 and 5.

In implementing the described circuits node 24 should be kept at as low an impedance as possible in order to keep AC errors down. The DC current through resistors 32, 34 and diode 20 should be kept large. In addition the positive (non-inverting) input to amplifier 10 should have high impedance in order to reduce the effects of input offset voltage on the output current. Since the current through transistor 4 could be as low as zero the capacitance at the collector of transistor 4 must be kept as low as possible by using a small device in order to prevent further reductions in the speed of this transistor.

What has been provided therefore is a voltage to absolute value current converter which accomplishes the conversion without the use of a capacitor and may therefore be easily implemented as an integrated circuit. While there have described above the principals of the invention and specific configurations in conjunction with specific devices, it is to be clearly understood that this description is made only by way of example and not as a limitation to the scope of the invention. For example amplifier 10 of FIG. 1 may be any of a number of high gain amplifiers which may be implemented in integrated circuit form and the specific implementation of amplifier 10 shown in FIG. 2 may be accomplished with a passive load in place of active load 30 without effecting the basic function of the circuit although the performance would be somewhat degraded. Also, a specific DC level other than zero may be obtained at the output using appropriate values for resistors 32, 34 and 36 as would be evident to one skilled in the art.

I claim:

1. A converter circuit comprising:

first and second transistors, each having a control terminal and first, second and third load terminals, said first load terminal of said first transistor coupled to said first load terminals of said second transistor for coupling to a source of supply voltage, said second load terminal of said first transistor coupled to said second load terminal of said second transistor and to the first terminal of a first resistor having first and second terminals, and said third load terminals of said first and second transistors respectively coupled to the first terminals of a second and third resistor each having first and second terminals;

a third transistor having a control terminal and first and second load terminals, said control terminal of said third transistor coupled to said second terminals of said second and third resistors and said first load terminal of said third transistor coupled to said second terminal of said first resistor;

a diode having anode and cathode terminals, said anode terminal coupled to said control terminal of said third transistor;

an amplifier having positive and negative input terminals and an output terminal, said positive input terminal coupled to said first load terminal of said third transistor and said negative input terminal coupled to said control terminal of said third transistor;

fourth and fifth transistors each having a control terminal and first and second load terminals, said first load terminal of said fourth transistor coupled to said positive input terminal of said amplifier, said control terminals of said fourth and fifth transistors coupled to said output terminal of said amplifier and said second load terminals of said fourth and fifth transistors coupled to said second load terminal of said third transistor and to said cathode terminal of said diode for coupling to a reference terminal.

2. A converter circuit in accordance with claim 1 wherein the resistance value of said first resistor is one half the resistance value of said second and third resistors which have equal resistance values.

3. A converter circuit in accordance with claim 1 wherein said first and second transistors are double emitter NPN transistors.

4. A converter circuit in accordance with claim 3 wherein said third, fourth and fifth transistors are NPN transistors.

5. A convertor circuit in accordance with claim 1 wherein said transistors, resistors, amplifier and diode are all contained in a single integrated circuit.

6. A converter circuit in accordance with claim 1 wherein said amplifier comprises:

sixth, seventh and eighth transistors each having a control terminal and first and second load terminals, said control terminal of said sixth transistor coupled to said control terminal of said third transistor, said control terminal of said seventh transistor coupled to said first load terminal of said fourth transistor, said second load terminal of said eighth transistor coupled to said control terminals of said fourth and fifth transistors;

a load having first and second terminals, said first terminal of said load coupled to said first load terminals of said seventh and eighth transistors for coupling to a source of supply voltage and said second terminal of said load coupled to said first load terminal of said sixth transistor and to said control terminal of said eighth transistor; and a fourth resistor having first and second terminals, said first terminal of said fourth resistor coupled to said second load terminals of said sixth and seventh transistors, and said second terminal of said fourth resistor coupled to said cathode terminal of said diode.

7. A converter circuit in accordance with claim 6 wherein said load comprises an active load.

* * * * *